United States Patent [19]

Vorhis, Jr. et al.

[11] 4,222,854

[45] Sep. 16, 1980

[54] CATALYTIC REFORMING OF NAPHTHA FRACTIONS

[75] Inventors: Frederick H. Vorhis, Jr., Mill Valley; Keith C. Bishop, III, San Rafael, both of Calif.

[73] Assignee: Chevron Research Company, San Francisco, Calif.

[21] Appl. No.: 41,964

[22] Filed: May 23, 1979

[51] Int. Cl.[2] ..... C10G 35/06; C10G 39/00

[52] U.S. Cl. ..... 208/80; 208/79; 208/93; 208/139

[58] Field of Search ..... 208/80, 92, 93, 139, 208/79

[56] References Cited

U.S. PATENT DOCUMENTS

| | | | |
|---|---|---|---|
| 3,011,967 | 12/1961 | Schmitkons et al. | 208/139 |
| 3,155,605 | 11/1964 | Lang et al. | 208/79 |
| 3,415,737 | 12/1968 | Kluksdahl | 208/139 |
| 4,002,555 | 1/1977 | Farnham | 208/80 |

*Primary Examiner*—Delbert E. Gantz
*Assistant Examiner*—G. E. Schmitkons
*Attorney, Agent, or Firm*—D. A. Newell; R. H. Davies; M. K. Bosworth

[57] ABSTRACT

Production of motor gasoline and a BTX-enriched reformate by fractionating a naphtha feedstock into a mid-boiling BTX-precursor fraction, a relatively high-boiling fraction and a relatively low-boiling fraction; catalytically reforming the BTX-precursor fraction in a first reforming zone; combining the relatively high-boiling and low-boiling fractions and catalytically reforming the combined fractions in a second reforming zone.

8 Claims, No Drawings

CATALYTIC REFORMING OF NAPHTHA FRACTIONS

FIELD OF THE INVENTION

The present invention is directed to the catalytic reforming of hydrocarbon fractions. More specifically, the present invention is concerned with reforming in parallel reaction zones specific fractions of a naphtha feedstock.

BACKGROUND OF THE INVENTION

Reforming of a hydrocarbon fraction is a common method for increasing the octane number and concentration of aromatics in the hydrocarbon fraction. Typical reforming catalysts comprise a hydrogenation-dehydrogenation component supported on a porous solid carrier. Typical catalysts include platinum on alumina with or without such promoters as rhenium, tin, iridium, etc. Typical reaction conditions include a temperature within the range from 700° to 1050° F., a pressure generally within the range from 25 to 1000 psig, a liquid hourly space velocity from 0.01 to 20, and a hydrogen to hydrocarbon molar ration from 0.5 to 20.

In recent years, due to the required phase down of lead in motor gasoline, it has become increasingly necessary to produce a reformate having higher and higher octane number for blending to make motor gasoline. To make this higher octane reformate, the reforming zone must be operated at increasingly severe conditions which in turn means increasingly reduced yields of the reformate. Refiners are constantly searching for methods which will allow them to increase the yield of $C_5+$ reformate while allowing them to maintain a given octane number.

Occasionally it is desirable to reform a particular fraction of the naphtha feedstock, for example, when it is desired to obtain a reformate enriched in a benzene-toluenexylene (BTX) fraction or at least one of the BTX components. After removal of the BTX-precursor stream, usually a heartcut of the naphtha feedstock, standard practice has been to separately reform the remaining light naphtha and heavy naphtha fractions at reforming conditions tailored specifically to the optimum reforming of each fraction. However, we have discovered a process which permits recovery of a surprisingly high yield of $C_5+$ reformate compared to that known process.

SUMMARY OF THE INVENTION

In accordance with one embodiment of the present invention, there is provided a process for reforming a naphtha feedstock in at least a first and a second reaction zone in parallel to produce a BTX-enriched product in one and a motor gasoline of a predetermined octane in the other which comprises separating said naphtha feedstock into a relatively high-boiling fraction, a middle-boiling fraction containing BTX precursors and a relatively low-boiling fraction, passing said middle-boiling fraction to said first reaction zone in contact with a reforming catalyst at reforming conditions and in the presence of hydrogen to produce said BTX-enriched product, forming a mixture of said relatively high-boiling fraction and said relatively said low-boiling fraction and passing said mixture to said second reaction zone in contact with a reforming catalyst at reforming conditions in the presence of hydrogen to produce said motor gasoline.

Preferably, the process is one in which a toluene and xylene enriched product and a motor gasoline of predetermined octane are produced with the middle-boiling fraction containing toluene and xylene precursors and the low-boiling fraction additionally containing benzene precursors.

Still more preferably, the process is one in which a xylene enriched product and a motor gasoline of predetermined octane are produced with the middle-boiling fraction containing xylene precursors and the low-boiling fraction additionally containing benzene and toluene precursors.

DETAILED DESCRIPTION

The naphtha feedstock used to produce high yields of motor gasoline and BTX products by means of the present invention should boil within the range from 100° to 550° F., preferably between 150° to 450° F. The feed may be a straight run naphtha, a thermally cracked naphtha, a catalytically cracked naphtha, a hydrocrackate, or blends thereof.

Prior to fractionating the feed into the three streams, it may be advantageous to hydrofine the feed to reduce the sulfur content or to hydrogenate olefinic components. Hydrogenating the feedstock in a presaturation zone is generally accomplished by contacting the feed with a hydrogenation catalyst which is resistent to sulfur poisoning.

The feed, preferably containing low amounts of sulfur and other poisons, is separated by conventional means such as fractionation into at least three streams: a middle-boiling fraction containing BTX precursors, and preferably primarily toluene and xylene precursors and still more preferably primarily xylene precursors, a lower-boiling fraction and a higher-boiling fraction. The BTX-precursor fraction will generally boil from 150° to 300° F., a toluene and xylene precursor fraction will generally boil from 180° to 300° C. and a zylene precursor fraction will generally boil from 200° to 220° F. to 300° F. For example, when the naphtha has an initial boiling range of 150° F. and an end point of 450° F., and the middle-boiling fraction contains primarily xylene precursors, the relatively low-boiling fraction will have a boiling range from 150° to 220° F., the middle-boiling fraction will boil within the range from 220° to 300° F., and the relatively high boiling fraction will boil within the range from 300° to 450° F. If necessary any $H_2S$, water, or light hydrocarbon gases may be removed from the fractionation zone as a separate stream.

Benzene precursors generally include $C_6$ compounds such as n-hexane and cyclohexane, toluene precursors generally include $C_7$ compounds such as n-heptane, methyl hexanes and methyl cyclohexanes, and xylene precursors generally include $C_8$ paraffins and naphthenes, e.g., dimethyl hexane and dimethyl cyclohexane.

The BTX-precursor containing fraction is processed separately from the mixture of the high and low boiling range naphtha fractions. However, reforming to produce BTX or xylene takes place within the same range of reforming conditions used by producing motor gasoline. The reforming conditions generally include a temperature of from 800° to 1050° F. and preferably from 850° to 1025° F. The pressures will generally be above atmospheric and less than 1000 psig, preferably from 25 to 300 psig and more preferably from 50 to 200 psig.

The temperature and pressure in the reforming zone can be correlated with the liquid hourly space velocity (LHSV) to favor any particularly desirable reforming reactions, as for example, dehydrocyclization or dehydrogenation or isomerization. In general the liquid hourly space velocity will be from 0.1 to 10 and preferably from 1 to 5. The reforming process is conducted in the presence of hydrogen. Hydrogen may be introduced from an extraneous source, for instance, when used only on a once-through basis. However, since reforming generally produces excess hydrogen, hydrogen produced in the reaction may be separated from the reformate and recycled to the reaction zone. Regardless of the source, hydrogen can be introduced into the feed prior to contact with the catalyst or it can be contacted simultaneously with the introduction of the feed to the reaction zone. The hydrogen need not necessarily be pure hydrogen, but may contain light hydrocarbon gases in admixture therewith. Generally when hydrogen is recirculated to the reaction zone some light hydrocarbon gases will be recirculated with it. Hydrogen is preferably introduced into the reaction zone at a rate which varies from 0.5 to 20 moles of hydrogen per mole of feed and preferably from 1 to 10 moles of hydrogen per mole of feed.

The reforming conditions vary, depending upon whether the feed used is highly aromatic, paraffinic or naphthenic and upon the desired octane rating of the product. Generally it is preferred that the reforming process be operated at high severity conditions, that is, conditions which all result in the production of a motor gasoline product having at least 90 research octane clear, more preferably at least 92 research octane clear and still more preferably at least 95 research octane clear.

The reforming zone may consist of one or several reactors containing hydrogenation-dehydrogenation catalyst. In the process of the present invention there are at least two reaction zones in parallel, one for reforming the naphtha stream containing BTX or xylene precursors and the other for reforming the mixture of the low-and high-boiling naphtha fractions. Each reaction zone may consist of one or several reactors in series. The hydrocarbon feed is mixed with hydrogen and preheated and then passed through the reaction zones containing catalyst. Generally the hydrocarbon feed is heated to the desired conversion temperature before being passed into each reactor. Reformed hydrocarbons are recovered from the terminal reactors and hydrogen is separated therefrom and a portion thereof may be recycled to the reactors.

The catalyst which finds use in reforming comprises a platinum group component associated with a porous solid carrier such as alumina. Platinum is the preferred platinum group component. Promoters which may be present on the catalyst include a halide and promoter metals such as rhenium, tin, iridium, etc. The platinum group component is generally present in an amount from 0.01 to 3 weight percent and preferably 0.1 to 1 weight percent, the halogen component preferably choride is generally present on the catalyst in an amount from 0.1 to 3 weight percent total halide content, and the promoter metal, if used, is generally present in an amount from 0.01 to 5 weight percent and preferably 0.1 to 2 weight percent. A particularly preferred catalyst is described in U.S. Pat. No. 3,415,737 which is incorporated herein by reference.

The following specific comparative example will serve to further illustrate the method of the present invention and the advantages thereof.

EXAMPLE

A series of comparison tests were run to determine what effect on yield that reforming a combined light and heavy feedstock to a given octane would have compared to reforming each feed separately. Four feedstocks were blended in various ways for the tests, and the analysis of each individual feedstock is shown in Table I.

TABLE I

| | Feedstocks | | | |
|---|---|---|---|---|
| | Light Straight Run (LSR) | Isomaxate Light Heart Cut (ILHC) | Heavy Heavy Straight Run (HHSR) | Heavy Isomaxate (HI) |
| Gravity °API | 63.6 | 69.8 | 52.9 | 49.4 |
| ASTM D-86 | | | | |
| IBP °F. | 194 | 114 | 261 | 303 |
| 10% °F. | 203 | 146 | 293 | 315 |
| 30% °F. | 208 | 165 | 313 | 325 |
| 50% °F. | 214 | 182 | 325 | 335 |
| 70% °F. | 221 | 198 | 339 | 346 |
| 90% °F. | 235 | 220 | 364 | 356 |
| EP °F. | 294 | 280 | 431 | 401 |
| Aromatics, Vol % | 6.5 | 5.1 | 16.9 | 16.0 |
| F-1 Octane Clear | 48.4 | 75.4 | 23.0 | 35.2 |

The individual feedstocks as well as various blends of them were contacted with a platinum-rhenium reforming catalyst at 200 psig to determine the yield-octane relationship. From these curves, the yield could be determined for a given octane for each of the blends.

As shown in the Table II, reforming a combined light + heavy feedstock to obtain a product having a research octane number of 95 has a significant yield advantage (4.5 liquid volume percent) compared with reforming the light feedstock and heavy feedstock separately:

TABLE II

| | Segregated | | Mixed Light + Heavy | |
|---|---|---|---|---|
| Feed | | | Straight | |
| Type | Lights | Heavies | Runs | Isomaxates |
| Component | LSR + ILHC | HHSR + HI | LSR + HHSR | ILHC + HI |
| Quantity, MBPD | 10 + 10 | 10 + 10 | 10 + 10 | 10 + 10 |
| Reformed Product | | | | |
| RON. Cler* | 93 | 97 | 94 | 96 |
| Simulated $C_5$+ yield, LV% | | | 77.5 | 80.5 |
| Actual $C_5$+ yield, LV % | 73 | 82 | 82 | 82 |
| Rx Temp | 930 | 875 | 900 | 900 |
| MBPD | 14.6 | 16.4 | 16.4 | 16.4 |

TABLE II-continued

| | Segregated | Mixed Light + Heavy |
|---|---|---|
| Blend of Product | | |
| Total MBPD | 31.0 | 32.8 |
| Blend RON (linear) | 95.1 | 95.0 |
| Simulated $C_5$+ yield, LV % | | 79 |
| Actual $C_5$+ yield, LV % | 77.5 | 82.0 |

*The octane number for the segregated heavy feed was selected to allow a reasonable run length for the catalyst, and the octane number for the segregated light feed was selected to produce a mixture having the target octane. The octane numbers for the light and heavy feeds were determined from the reforming temperature needed to produce a blend with the required octane.

Similar calculations show a similar yield advantage of 4.5 vol % for a blend having a research octane number of 98, while for a blend having a research octane number of 91, the yield advantage is 3 vol %.

The unexpected benefits from reforming the low-boiling and high-boiling fractions as a mixture rather than reforming each separately at individually tailored conditions include:

(1) an increase in the yield of motor gasoline
(2) a decrease in the light ends (gas make)
(3) an increase in hydrogen purity
(4) an increased run length between regenerations
(5) a potential for increased reforming severity.

A possible explanation of the yield advantage attributed to the present invention is that reforming low-boiling fractions to a 93 research octane number requires extensive cracking of $C_6$ and $C_7$ paraffins to light gases. When these low-boiling fractions are mixed with high-boiling fractions, this permits heavy molecules to be reformed which are not reformed at similar conditions without the low-boiling fraction being present. Thus, for a given octane product, combining the low- and high-boiling naphtha fractions allows decreased cracking of the light paraffins and increased reforming of the heavy molecules. The above theory is presented as one possible explanation of the mechanism of this invention and we do not necessarily wish to be bound or limited thereby.

Other embodiments of the invention will be apparent to the skilled in the art from a consideration of the specification or practice of the invention described herein. It is intended that the specification and examples be considered exemplary only with the true scope and spirit of the invention being indicated by the following claims.

What is claimed is:

1. A process for reforming a naphtha feedstock in at least a first and second reaction zone in parallel to produce a benzene-toluene-xylene (BTX) enriched product in one of said zones and a motor gasoline of a predetermined octane in the other of said zones which comprises separating said naphtha feedstock into a relatively high-boiling fraction, a middle-boiling fraction containing BTX precursors and a relatively low-boiling fraction, passing said middle-boiling fraction to said first reaction zone in contact with a reforming catalyst at reforming conditions and in the presence of hydrogen to produce said BTX-enriched product, forming a mixture of said relatively high-boiling fraction and said relatively low-boiling fraction and passing said mixture to said second reaction zone in contact with a reforming catalyst at reforming conditions and in the presence of hydrogen to produce said motor gasoline.

2. The process of claim 1 wherein said second reaction zone contains at least two reactors and said mixture is divided into two homogeneous portions and said portions are passed in parallel flow to said reactors.

3. The process of claim 1 wherein said middle-boiling fraction boils within the range of 150° to 300° F.

4. The process of claim 1 wherein said middle-boiling fraction contains toluene and xylene precursors and said low-boiling fraction additionally contains benzene precursors.

5. The process of claim 4 wherein said middle-boiling fraction boils within the range of 180° to 300° F.

6. The process of claim 1 wherein said middle-boiling fraction contains xylene precursors and said low-boiling fraction additionally contains benzene and toluene precursors.

7. The process of claim 6 wherein said middle-boiling fraction boils within the range of 200° to 300° F.

8. The process of claim 6 wherein said middle-boiling fraction boils within the range of 220° to 300° F.

* * * * *